United States Patent [19]

Hacetoglu et al.

[11] Patent Number: 4,645,130

[45] Date of Patent: Feb. 24, 1987

[54] METHOD FOR TREATING CARBIDE-BASED DESULFURIZING REAGENTS FOR INJECTION INTO MOLTEN IRON

[75] Inventors: Ararat Hacetoglu, Fonthill; William K. Kodatsky, Mississauga; Ray O. Gonzales, Jr., Thorold, all of Canada

[73] Assignee: American Cyanamid Company, Stamford, Conn.

[21] Appl. No.: 764,156

[22] Filed: Aug. 9, 1985

[30] Foreign Application Priority Data

Dec. 4, 1984 [CA] Canada ..... 469240

[51] Int. Cl.[4] ..... B02C 19/12

[52] U.S. Cl. ..... 241/16

[58] Field of Search ..... 241/16, 21, 30, 22; 75/53, 58

[56] References Cited

U.S. PATENT DOCUMENTS

| | | | |
|---|---|---|---|
| 2,203,809 | 6/1940 | Bechtold | 241/16 X |
| 3,443,976 | 5/1969 | Dodson et al. | 241/16 X |
| 4,528,031 | 7/1985 | Hacetoglu et al. . | |

FOREIGN PATENT DOCUMENTS

| | | | |
|---|---|---|---|
| 2142840 | 1/1985 | United Kingdom | 241/16 |

*Primary Examiner*—Mark Rosenbaum

*Attorney, Agent, or Firm*—Frank M. Van Riet

[57] ABSTRACT

In the manufacture of a carbide-based desulfurizing reagent wherein large agglomerations of material are milled into fine particles, an organic, polar liquid is added to said reagent before or during said milling.

2 Claims, No Drawings

METHOD FOR TREATING CARBIDE-BASED DESULFURIZING REAGENTS FOR INJECTION INTO MOLTEN IRON

BACKGROUND OF THE INVENTION

A desulfurizing reagent (DSR) is any material which, when added to hot metal such as molten iron alloy, reduces the sulfur content thereof. Such materials include diamide lime, calcium oxide, calcium carbonate, calcium fluoride and various carbon forms.

Thus, a calcium-based desulfurizing reagent is a DSR in which the principal constituent is calcium carbide, preferably furnace calcium carbide, and optionally includes, as lesser constituents, diamide lime, carbon, calcium carbonate, calcium fluoride and/or other materials used in treating hot metal.

While calcium carbide can be used from any source, furnace calcium carbide is generally used in desulfurizing procedures for treating hot metal. Furnace calcium carbide is a commercially available carbide which is 70–85%, by weight, $CaC_2$ and is produced in an electric furnace.

As recovered from the electric furnace, the carbide is in the form of large agglomerations which are generally first broken down into chunks of about 1–2 inches in diameter and then milled in a grinding mill or series of grinding mills, either in a closed or open circuit, into fine particles. The need for the fine particles is a requirement of the metal producers using the DSR in order to assure that the DSR possesses as high a surface area as possible. Therefore, if a method could be found for the formation of fine particulate DSR whereby the particles are more uniform in size, a step forward in the art would be realized.

SUMMARY OF THE INVENTION

The incorporation of an organic, polar liquid into particulate DSR before or during the milling thereof into fine particles has been found to increase the efficiency of the milling and thereby increase the surface area of the DSR and the particle size reduction thereof.

DESCRIPTION OF THE INVENTION INCLUDING PREFERRED EMBODIMENTS

The present invention is directed to a process wherein large agglomerations of carbide-based desulfurizing reagents are milled into very fine particles, the improvement therein comprising adding an organic, polar liquid to said large agglomerations before or during said milling.

The use of organic, polar liquids in the processing of desulfurizing reagents is known. The organic, polar liquids are added, however, to the DSR after the fine particles produced during the milling operation have been produced. Canadian Application Ser. No. 429759-8, filed 6/6/83, by two of the inventors of the present application, is directed to such a process and describes the liquids as flow promotors which reduce the clogging and lumping of the DSR while injecting it into the molten metal by means of a lance submersed in the hot metal.

In accordance with the present invention, the addition of the organic, polar liquid before or during the milling results in free-flowing DSR of increased surface area and a higher concentration of fine particles than if the liquid is omitted.

Any of the DSR materials discussed above benefit from the advantages imparted by the process of the present invention. Also, as a DSR, it is known to use furnace calcium carbide together with diamide lime, the latter being obtained as a by-product in the manufacture of hydrogen cyanamide. Such DSR systems may also be used as feed materials in the process of the present invention. Such diamide lime usually comprises 85% calcium carbonate and 11% carbon, in graphitic form. As a component of the DSR, it acts as a gas releasing material and aids in the calcium carbide separating and mixing with the hot metal.

The organic, polar liquid which is added before or during the carbide desulfurizing reagent milling operation should be substantially inert with respect to the DSR. Suitable liquids include any compound with up to 10 carbon atoms which is preferably an alcohol, ester, ketone, ether, aldehyde or halogenated alkane. Specific organic polar liquids include aliphatic alcohols such as methanol, ethanol, n- and i-propyl alcohol, n-, i- and t-butyl alcohol, allyl alcohol, n-octanol, 2-ethylhexyl alcohol and ethylene glycol; aromatic alcohols such as benzyl alcohol, 2-phenethyl alcohol; hydroxyalkylamines such as 3-bis(hydroxyethyl)propylamine; heterocyclic alcohols such as furfuryl alcohol and tetrahydrofurfuryl alcohol; ketones such as acetone, ethyl methyl ketone, di-n-propyl ketone, di-n-butyl ketone and di-i-butyl ketones; esters such as methyl acetate, propyl acetate, amyl acetate, benzyl acetate, methyl propionate and propyl propionate; ethers such as di-n- and iso-propyl ether, di-n-butylether, di-amylether, propyl butyl ether and dibenzylether; aldehydes such as acetaldehyde; halogenated alkanes such as ethyl chloride, and the like. Mixtures of these polar liquids may also be used.

The alcohols, ethers, ketones, and mixtures thereof are preferred and in particular isopropyl alcohol, isoamyl alcohol, t-butyl alcohol and mixtures thereof are even more preferred.

The organic, polar liquid is added to the particulate material in an amount of about 0.001 to about 1.0%, by weight, and preferably in an amount of about 0.01 to 0.5%, by weight.

The following examples are set forth for purposes of illustration only and are not to be construed as limitations on the present invention except as set forth in the appended claims. All parts and percentages are by weight unless otherwise specified.

EXAMPLE 1

An experimental, ball mill ground, 100% furnace carbide DSR (designated as Sample A) having a mesh size of less than about 500 m is charged to a continuous discharge ball mill and ground for about 30 minutes after having had added thereto varying concentrations of various organic polar liquids. The results are set forth in Table I, below, including comparative runs wherein the liquid is added after the ball milling.

TEST DESCRIPTION

A 100 gram sample is screened through a 150 mesh Tyler screen (106 μm opening) for 20 minutes using a testing sieve shaker. The +150 fraction is calculated by dividing the weight of oversize (retained on screen) sample by the total sample weight. The fines (−150 mesh) are tested for particle size distribution using a HIAC/ROYCO Automatic Particle Size Analysis System which provides a plot of cumulative percent of sample retained vs. particle size. The weight percent smaller than 30 μm is used as an indication of particle size distribution at the lower end of the scale. The +150 mesh fraction is not considered in this −30 μm number. Table I also shows the actual −30 μm weight percent of the whole sample.

TABLE I

| Example | Sample | Additive | Rate | Addition | +150 MESH % | HIAC % | Actual −30 μm Wt. % | Flow No. |
|---|---|---|---|---|---|---|---|---|
| 1 | A | IPA | .05 | In Mill | 9.2 | 66 | 60 | — |
| 2 | A | " | .10 | " | 4.1 | 65 | 62 | 1.5 |
| 3 | A | " | .20 | " | 3.2 | 69 | 67 | — |
| 4 | A | IAA | .05 | " | 3.0 | 73 | 71 | — |
| 5 | A | " | .10 | " | 2.3 | 71 | 69 | — |
| 6 | A | " | .15 | " | 2.7 | — | — | — |
| 7 | A | TBA | .10 | " | 5.4 | 70 | 68 | — |
| 8c | A | IPA | .10 | Post Mill | 18.1 | 71 | 58 | 1.0 |
| 9c | A | — | — | — | 35.6 | 68 | 44 | 4.0 |
| 10c | B | TBA | .10 | Post Mill | 2.0 | 60 | 59 | — |
| 11c | B | IPA | .10 | " | 9.9 | 62 | 56 | — |
| 12c | B | — | — | — | 14.6 | 59 | 50 | — |

c = comparative
IPA = isopropyl alcohol
IAA = isoamyl alcohol
TBA = t-butyl alcohol
Sample B = 100% Furnace Carbide ground in plant ball mill. Feed size: dust to 2 in. dia.

EXAMPLES 13–17

Following the procedure of Example 3, various other organic, polar liquids are substituted for the isopropyl alcohol used therein. The liquids are:

(13) A 50/50 mixture of acetone and methanol.
(14) Butyl acetate.
(15) Ethylene glycol.
(16) Methyl ethyl ketone.
(17) Acetaldehyde.

In each instance, the percentage of +150 mesh particles is decreased as compared to Sample A without any additive.

EXAMPLE 18c

The use of silicone oil in place of the isopropyl alcohol of Example 3 does not decrease the percentage of +150 mesh particles of Sample A.

We claim:

1. In a process where large agglomerations of furnace calcium carbide are milled into very fine particles, the improvement which comprises adding an alcohol to said large agglomerations before or during milling whereby the quantity of fine particles produced is increased.

2. The method of claim 1 wherein the alcohol is added in an amount ranging from about 0.001 to about 1.0 percent, by weight.

* * * * *